US009598842B2

(12) United States Patent
Imura et al.

(10) Patent No.: US 9,598,842 B2
(45) Date of Patent: Mar. 21, 2017

(54) CONSTRUCTION MACHINERY

(71) Applicant: HITACHI CONSTRUCTION MACHINERY CO., LTD., Tokyo (JP)

(72) Inventors: Shinya Imura, Tokyo (JP); Hidetoshi Satake, Ishioka (JP); Kouji Ishikawa, Tsuchiura (JP); Seiji Hijikata, Tsuchiura (JP); Tomoaki Kaneta, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 314 days.

(21) Appl. No.: 14/377,580

(22) PCT Filed: Feb. 5, 2013

(86) PCT No.: PCT/JP2013/052550
§ 371 (c)(1),
(2) Date: Aug. 8, 2014

(87) PCT Pub. No.: WO2013/121922
PCT Pub. Date: Aug. 22, 2013

(65) Prior Publication Data

US 2015/0247305 A1 Sep. 3, 2015

(30) Foreign Application Priority Data

Feb. 17, 2012 (JP) ..... 2012-033270

(51) Int. Cl.
*E02F 9/22* (2006.01)
*F15B 21/14* (2006.01)
(Continued)

(52) U.S. Cl.
CPC ..... *E02F 9/2292* (2013.01); *E02F 9/2075* (2013.01); *E02F 9/2095* (2013.01);
(Continued)

(58) Field of Classification Search
CPC ..... E02F 9/2217; E02F 9/2075; E02F 9/2292; F15B 11/024
See application file for complete search history.

(56) References Cited

U.S. PATENT DOCUMENTS

2003/0221339 A1* 12/2003 Naruse ..... E02F 9/2217 37/348

FOREIGN PATENT DOCUMENTS

JP 3-52403 U 5/1991
JP 5-287774 A 11/1993
(Continued)

*Primary Examiner* — Eric Keasel
*Assistant Examiner* — Abiy Teka
(74) *Attorney, Agent, or Firm* — Baker Botts L.L.P.

(57) ABSTRACT

Provided is construction machinery that is capable of greatly reducing the amount of fuel consumption by making effective use of recovered energy. The construction machinery has a first hydraulic pump 3 for discharging hydraulic oil for driving an actuator 6, a second hydraulic pump 9, a second prime mover 7 for driving the second hydraulic pump 9, energy storage device 8 for storing energy for driving the second prime mover 7, and a hydraulic oil supply circuit 10 including a hydraulic oil switching section 11*c* that accepts the hydraulic oil discharged from the first hydraulic pump and the hydraulic oil discharged from the second hydraulic pump and supplies either the mixture of the accepted hydraulic oils or a selected one of the accepted hydraulic oils to the actuator 6. The construction machinery includes a control device 20 that, when the drive efficiency of the second hydraulic pump 9 and/or the amount of energy stored in the energy storage device 8 is higher than a preselected setting value, outputs a switch command to the hydraulic oil switching section 11*c* and outputs a drive command to the second prime mover 7.

9 Claims, 7 Drawing Sheets

(51) Int. Cl.

| | |
|---|---|
| ***E02F 9/20*** | (2006.01) |
| ***F15B 11/024*** | (2006.01) |
| ***F15B 15/14*** | (2006.01) |

(52) U.S. Cl.

CPC ..... *E02F 9/2217* (2013.01); *E02F 9/2242* (2013.01); *E02F 9/2296* (2013.01); *F15B 11/024* (2013.01); *F15B 15/14* (2013.01); *F15B 21/14* (2013.01); *F15B 2211/2053* (2013.01); *F15B 2211/20515* (2013.01); *F15B 2211/20546* (2013.01); *F15B 2211/20569* (2013.01); *F15B 2211/20576* (2013.01); *F15B 2211/31558* (2013.01); *F15B 2211/41518* (2013.01); *F15B 2211/88* (2013.01)

(56) References Cited

FOREIGN PATENT DOCUMENTS

| | | | |
|---|---|---|---|
| JP | 2000-136806 | A | 5/2000 |
| JP | 2011-163291 | A | 8/2011 |
| JP | 2011-174491 | A | 9/2011 |

* cited by examiner

| AMOUNT OF STORED ELECTRIC ENERGY \ DISCHARGE PRESSURE | LOW | HIGH |
|---|---|---|
| LARGE | DRIVE | DRIVE |
| MEDIUM | STOP | DRIVE |
| SMALL | STOP | STOP |

CONSTRUCTION MACHINERY

FIELD OF THE INVENTION

The present invention relates to construction machinery, and more particularly to construction machinery having two or more hydraulic pumps for supplying hydraulic oil to an actuator.

BACKGROUND ART

In general, a hydraulic excavator, which belongs to construction machinery, includes a prime mover such as an engine, a hydraulic pump driven by the prime mover, a hydraulic actuator, and a control valve for switching to the hydraulic actuator and supplying the hydraulic oil from the hydraulic pump to the hydraulic actuator, the hydraulic actuator being for driving, for example, a boom, an arm, a bucket, or a swing structure by use of a hydraulic oil discharged from the hydraulic pump. A technology proposed for such construction machinery retrieves the potential energy of the boom falling under its own weight and the kinetic energy of inertia of the swing structure and makes effective use of the recovered energy in order to reduce the motive power of a motive power source for the purpose of reducing the fuel consumption of the whole construction machinery.

A hydraulic oil energy recovery/regeneration device disclosed, for instance, in Patent Document 1 includes a hydraulic actuator, a recovery device, an energy storage device, and regeneration device. The hydraulic actuator is driven when hydraulic oil discharged from a hydraulic actuator drive hydraulic pump is supplied. The recovery device recovers returning hydraulic oil that flows out of the hydraulic actuator. The energy storage device converts the energy of the recovered returning hydraulic oil to a predetermined energy and stores the resulting energy. The regeneration device uses the energy stored in the energy storage device to supplement the energy for driving the hydraulic actuator drive hydraulic pump. The energy storage device includes a recovery hydraulic motor, a generator, and a battery. The recovery hydraulic motor is driven when the returning hydraulic oil flowing out of the hydraulic actuator flows into the recovery hydraulic motor. The generator generates electric energy when the driving force of the recovery hydraulic motor is input to the generator. The battery stores the electric energy generated by the generator. The regeneration device includes a regeneration device that uses the electric energy stored in the battery to supplement the energy for driving the hydraulic actuator drive hydraulic pump.

PRIOR ART LITERATURE

Patent Document

Patent Document 1: JP-2000-136806-A

SUMMARY OF THE INVENTION

Problems to be Solved by the Invention

According to the conventional technology described in Patent Document 1, the electric energy stored in the battery drives the generator as an electric motor and further drives the recovery hydraulic motor as a regeneration hydraulic pump. This driving makes it possible to reduce the discharge rate of the hydraulic actuator drive hydraulic pump (hereinafter referred to as the main pump). This decrease results in a decline in the load imposed on an engine that drives the main pump. Consequently, the amount of fuel consumption can be reduced.

Meanwhile, the electric motor for driving the regeneration hydraulic pump needs to generate not only a torque necessary for generating the discharge pressure of the regeneration hydraulic pump, but also a torque for counteracting the friction and resistance to stirring (hereinafter referred to as the resistance torque), which are generated due to the rotation of the regeneration hydraulic pump. Therefore, when, for instance, the regeneration hydraulic pump is driven under a low discharge pressure, the ratio of the resistance torque to the whole torque of the electric motor turns out to be higher than the case that the regeneration hydraulic pump is driven under a high discharge pressure.

For example, if the electric energy recovered into the battery is consumed to drive the electric motor in order to drive the regeneration hydraulic pump under a low discharge pressure, such that the regeneration hydraulic pump cannot be driven under a high discharge pressure, most of the recovered energy is practically consumed by the resistance torque. This will lead to a decrease in energy efficiency.

Consequently, the timing at which the recovered energy is regenerated and reused (the timing at which the electric motor drives the regeneration hydraulic pump) needs to be taken into account when the energy efficiency is to be increased to sufficiently reduce the amount of fuel consumption.

Although Patent Document 1 discloses the hydraulic oil energy recovery/regeneration device, it does not describe, for example, the timing at which the energy is regenerated and reused.

The present invention has been made in view of the above circumstances. An object of the present invention is to provide construction machinery that is capable of greatly reducing the amount of fuel consumption by making efficient use of recovered energy.

Means for Solving the Problems

In accomplishing the above object, according to a first aspect of the present invention, there is provided construction machinery having an actuator, a first hydraulic pump, a first prime mover, a second hydraulic pump, a second prime mover, an energy storage device, and a hydraulic oil supply circuit. The first hydraulic pump discharges hydraulic oil for driving the actuator. The first prime mover drives the first hydraulic pump. The second hydraulic pump discharges hydraulic oil for driving the actuator. The second prime mover drives the second hydraulic pump. The energy storage device stores energy for driving the second prime mover. The hydraulic oil supply circuit includes a hydraulic oil switching section that accepts hydraulic oil discharged from the first hydraulic pump and hydraulic oil discharged from the second hydraulic pump and supplies either a mixture of the accepted hydraulic oils or a selected one of the accepted hydraulic oils to the actuator. The construction machinery further includes a control device that, when the drive efficiency of the second hydraulic pump and/or an amount of energy stored in the energy storage device is higher than a preselected setting value, outputs a switch command to the hydraulic oil switching section and outputs a drive command to the second prime mover.

According to a second aspect of the present invention, there is provided the construction machinery as described in the first aspect, further including a control device that, when the drive efficiency of the second hydraulic pump is lower than a preselected setting value, outputs a switch command to the hydraulic oil switching section and a rotation speed reduction command or a stop command to the second prime mover.

According to a third aspect of the present invention, there is provided the construction machinery as described in the second aspect, further including a discharge pressure detection device for detecting the discharge pressure of the first hydraulic pump. The control device acquires the discharge pressure of the first hydraulic pump, which is detected by the discharge pressure detection device. When the discharge pressure of the first hydraulic pump is higher than a predetermined reference pressure, the control device outputs a drive command to the second prime mover. When the discharge pressure of the first hydraulic pump is lower than the predetermined reference pressure, the control device outputs a rotation speed reduction command or a stop command to the second prime mover. The control device outputs a switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the discharge pressure of the first hydraulic pump is higher than the predetermined reference pressure, and supply the hydraulic oil discharged from the first hydraulic pump to the actuator when the discharge pressure of the first hydraulic pump is lower than the predetermined reference pressure.

According to a fourth aspect of the present invention, there is provided the construction machinery as described in the second or third aspect, further including an output detection device for detecting the output of the energy storage device. The control device acquires the output of the energy storage device, which is detected by the output detection device. When the ratio of the output of the second hydraulic pump to the output of the energy storage device is higher than the predetermined reference value, the control device outputs a drive command to the second prime mover. When the ratio of the output of the second hydraulic pump to the output of the energy storage device is lower than the predetermined reference value, the control device outputs a rotation speed reduction command or a stop command to the second prime mover. The control device outputs a switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the ratio of the output of the second hydraulic pump to the output of the energy storage device is higher than the predetermined reference value, and supply the hydraulic oil discharged from the first hydraulic pump to the actuator when the ratio of the output of the second hydraulic pump to the output of the energy storage device is lower than the predetermined reference value.

According to a fifth aspect of the present invention, there is provided the construction machinery as described in any one of the second to fourth aspects, further including a torque detection device for detecting the drive torque of the second prime mover. The control device acquires the drive torque of the second prime mover, which is detected by the torque detection device. When the drive torque of the second prime mover is higher than the predetermined reference torque, the control device outputs a drive command to the second prime mover. When the drive torque of the second prime mover is lower than the predetermined reference torque, the control device outputs a rotation speed reduction command or a stop command to the second prime mover. The control device outputs a switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the drive torque of the second prime mover is higher than the predetermined reference torque and supply the hydraulic oil discharged from the first hydraulic pump to the actuator when the drive torque of the second prime mover is lower than the predetermined reference torque.

According to a sixth aspect of the present invention, there is provided the construction machinery as described in any one of the third to fifth aspects, further including a discharge pressure detection device for detecting the discharge pressure of the first hydraulic pump. The control device acquires the discharge pressure of the first hydraulic pump, which is detected by the discharge pressure detection device. When the discharge pressure of the first hydraulic pump is within the predetermined reference pressure range, the control device outputs a drive command to the second prime mover. When the discharge pressure of the first hydraulic pump is outside the predetermined reference pressure range, the control device outputs a rotation speed reduction command or a stop command to the second prime mover. The control device outputs a switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the discharge pressure of the first hydraulic pump is within the predetermined reference pressure range and supply the hydraulic oil discharged from the first hydraulic pump to the actuator when the discharge pressure of the first hydraulic pump is outside the predetermined reference pressure range.

According to a seventh aspect of the present invention, there is provided the construction machinery as described in any one of the second to sixth aspects, further including an energy detection device for detecting the amount of energy stored in the energy storage device. The control device acquires the amount of energy stored in the energy storage device, which is detected by the energy detection device. When the amount of energy stored in the energy storage device is higher than predetermined reference energy, the control device outputs a drive command to the second prime mover. When the amount of energy stored in the energy storage device is lower than the predetermined reference energy, the control device outputs a rotation speed reduction command or a stop command to the second prime mover. The control device outputs a switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the amount of energy stored in the energy storage device is higher than the predetermined reference energy, and supply the hydraulic oil discharged from the first hydraulic pump to the actuator when the amount of energy stored in the energy storage device is lower than the predetermined reference energy.

Advantages of the Invention

The present invention provides construction machinery that makes effective use of the recovered energy in order to lower the motive power of a motive power source for the purpose of greatly reducing the fuel consumption of the whole construction machinery. As a result, the operating time of the construction machinery will be longer to provide enhanced productivity.

MODE FOR CARRYING OUT THE INVENTION

Embodiments of the present invention will now be described with reference to the accompanying drawings. In the following description, a hydraulic excavator is cited as an example of construction machinery. The present invention is applicable to the whole construction machinery (including work machines). The application of the present invention is not limited to hydraulic excavators.

First Embodiment

Figure 1:
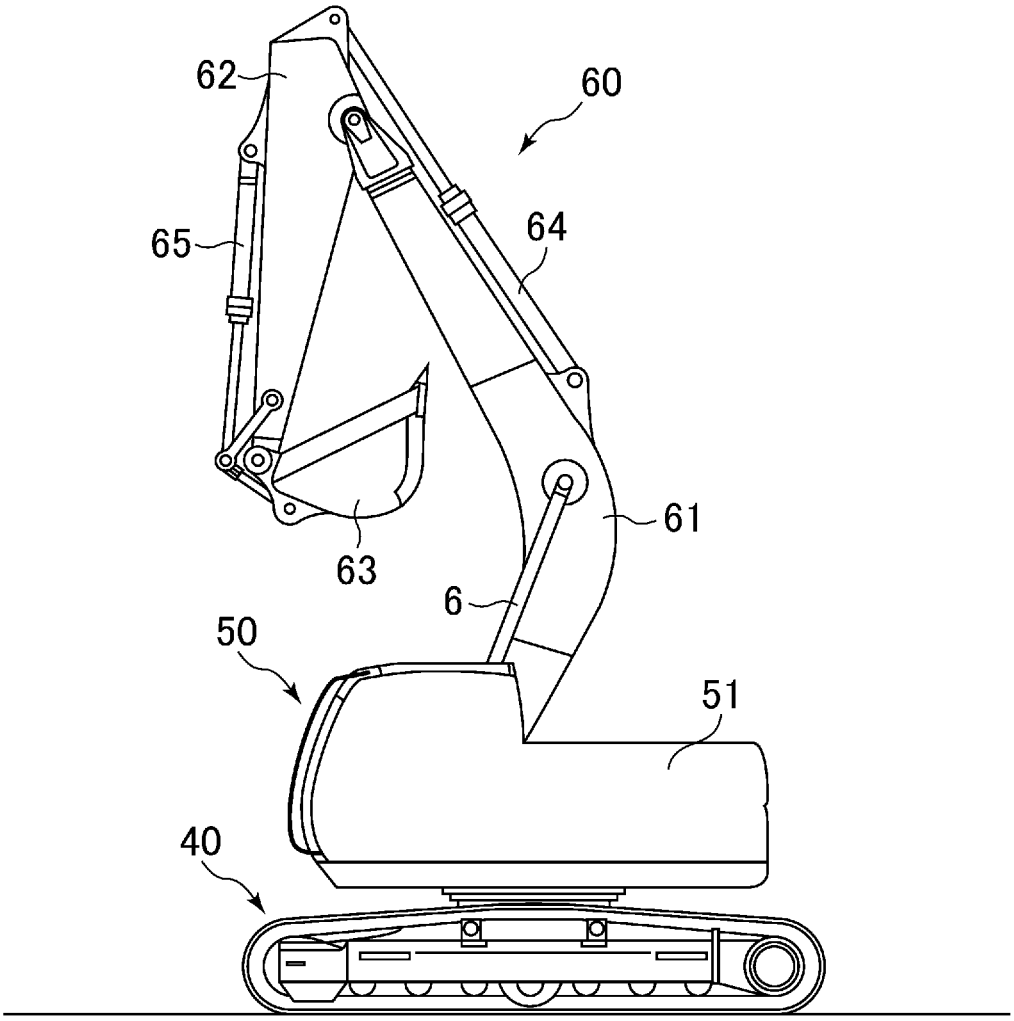
FIG. 1 is a side view illustrating a first embodiment of construction machinery according to the present invention.

With reference to FIG. 1, an electrically-operated hydraulic excavator includes a travel structure 40, a swing structure 50, and an excavating mechanism 60. The swing structure 50 is swingably mounted on the travel structure 40. The excavating mechanism 60 is mounted on the swing structure 50.

The excavating mechanism 60 includes, for example, a boom 61, a boom cylinder 6, an arm 62, an arm cylinder 64, a bucket 63, and a bucket cylinder 65. The boom cylinder 6 drives the boom 61. The arm 62 is pivotally supported on the vicinity of the leading end of the boom 61. The arm cylinder 64 drives the arm 62. The bucket 63 is pivotally supported on the leading end of the arm 62. The bucket cylinder 65 drives the bucket 63.

A prime mover chamber 51 is disposed on the rear of the swing structure 50 to house, for example, a later-described engine and main pump.

Figures 2, 3:
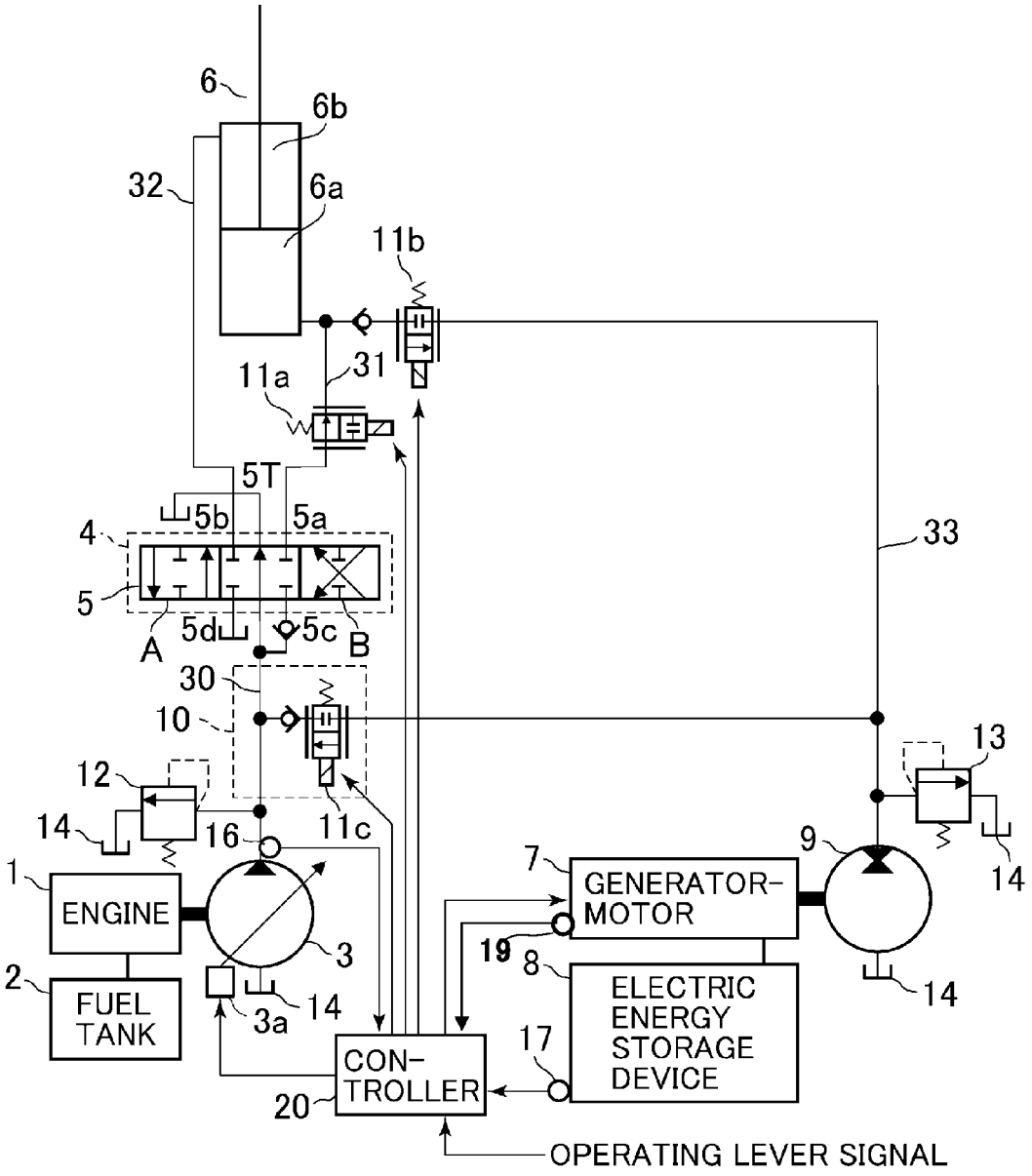
FIG. 2 is a system configuration diagram illustrating electric/hydraulic devices included in the first embodiment of the construction machinery according to the present invention.
FIG. 3 is a table illustrating an example of hydraulic pump/motor drive conditions for a controller included in the first embodiment of the construction machinery according to the present invention.

The system configuration of electric/hydraulic devices included in the hydraulic excavator will now be described with reference to FIG. 2. In the first embodiment, the boom cylinder 6 is described as an example of an actuator. FIG. 2 is a system configuration diagram illustrating the electric/hydraulic devices included in the first embodiment of the construction machinery according to the present invention. Elements that are shown in FIG. 2 and designated by the same reference numerals as elements shown in FIG. 1 are identical with the elements shown in FIG. 1 and will not be described in detail.

With reference to FIG. 2, the reference numeral 1 denotes an engine (first prime mover) that acts as a motive power source; the reference numeral 2 denotes a fuel tank for storing a fuel to be supplied to the engine; the reference numeral 3 denotes a variable-displacement main pump (first pump) driven by the engine 1; the reference numeral 4 denotes a control valve that acts as flow rate adjustment device; the reference numeral 5 denotes a boom operation regulating valve; the reference numeral 6 denotes a boom cylinder; the reference numeral 7 denotes a generator-motor (second prime mover); the reference numeral 8 denotes electric energy storage device (energy storage device) formed of a capacitor or a battery; the reference numeral 9 denotes a hydraulic pump/motor (second hydraulic pump) driven by the generator-motor 7; the reference numeral 10 denotes a hydraulic oil supply circuit for mixing the hydraulic oil discharged from the main pump 3 with the hydraulic oil discharged from the hydraulic pump/motor 9; the reference numerals 11*a* to 11*c* each denote a switching valve; and the reference numeral 20 denotes a controller (control device). The main pump 3 includes an inclined axis as a variable displacement mechanism. A displacement control device 3*a* adjusts the inclination angle of the inclined axis to vary the displacement of the main pump 3 for the purpose of controlling the discharge rate of the hydraulic oil.

A main line 30 for supplying the hydraulic oil discharged from the main pump 3 to various actuators such as the boom cylinder 6 is provided with a relief valve 12, which limits the pressure of the hydraulic oil in the main line 30, and the control valve 4, which controls the direction and flow rate of the hydraulic oil. When the pressure in hydraulic piping rises above a preselected pressure, the relief valve 12 allows the hydraulic oil in the main line 3 to flow into a hydraulic oil tank 14.

The control valve 4 acting as the flow rate adjustment device includes the regulating valve 5 for operating the boom. The regulating valve 5 for operating the boom is a 3-position, 6-port switching control valve that varies the opening area of a hydraulic oil flow path by changing the position of the regulating valve 5 in accordance with a pilot pressure supplied to both pilot-operated sections (not shown) of the regulating valve 5. This ensures that the boom cylinder 6 is driven by controlling the direction and flow rate of the hydraulic oil supplied from the main pump 3 to the boom cylinder 6. Further, the regulating valve 5 for operating the boom includes an inlet port 5*c* to which the hydraulic oil from the main pump 3 is supplied, an outlet port 5*d* that is in communication with the hydraulic oil tank 14, a center port 5T that establishes communication in neutral position, and connection ports 5*a*, 5*b* that provide connection to the boom cylinder 6.

The boom cylinder 6 includes a cylinder and a piston rod. The cylinder includes an oil chamber 6*a* on a bottom side and an oil chamber 6*b* on a rod side. The bottom side oil chamber 6*a* is connected to one end of a first line 31 in which the later described switching valve 11*a* is disposed. The other end of the first line 31 is connected to the connection port 5*a* of the regulating valve 5 for operating the boom. The rod side oil chamber 6*b* is connected to one end of a second line 32. The other end of the second line 32 is connected to the connection port 5*b* of the boom operation regulating valve.

The generator-motor 7 performs either power running control or regeneration control in accordance with a command from the later-described controller 20. During the power running control, torque is generated with the use of the electric power of the electric energy storage device 8. During the regeneration control, electric power is generated when the torque is absorbed. The generated power is then stored in the electric energy storage device 8, which acts as the energy storage device.

The rotating shaft of the hydraulic pump/motor 9 is coupled directly to or coupled mechanically through gears or the like to the rotating shaft of the generator-motor 7. When the generator-motor 7 is subjected to power running control, the hydraulic pump/motor 9 operates as a hydraulic pump so that the hydraulic oil is suctioned from the hydraulic oil tank 14 and discharged to a later-described sub-line 33. When, on the other hand, the generator-motor 7 is subjected to regeneration control, the hydraulic pump/motor 9 operates as a hydraulic motor and is rotated by means of the pressure of the hydraulic oil from the later-described sub-line 33.

A relief valve 13 and the switching valves 11*b*, 11*c* are disposed in the sub-line 33 to which the hydraulic oil from the hydraulic pump/motor 9 is discharged when the hydraulic pump/motor 9 operates as a hydraulic pump. The relief vale 13 limits the pressure of the hydraulic oil in the sub-line 33. The switching valves 11*b*, 11*c* exercise control to allow the hydraulic oil to flow or block the flow thereof. When the pressure in the hydraulic piping rises above a preselected pressure, the relief valve 13 allows the hydraulic oil in the sub-line 33 to flow into the hydraulic oil tank 14. The switching valves 11*b*, 11*c* are 2-port, 2-position electromagnetic switching valves and subjected to switching control in accordance with a command from the later-described controller 20.

One port of the switching valve 11*b* is connected to the outlet side of a check valve that permits only an outflow from the first line 31. The other port of the switching valve 11*b* is connected to the sub-line 33. One port of the switching valve 11*c* is connected to the inlet side of a check valve that permits only an inflow to the main line 30. The other port of the switching valve 11*c* is connected to the sub-line 33.

A hydraulic oil supply circuit 10 is formed by the switching valve 11*c*, which acts as a hydraulic oil switching section, and by the check valve that is connected to one port of the switching valve 11*c* to permit only the inflow to the main line 30 from the sub-line 33. The hydraulic oil supply circuit 10 exercises control in accordance with a command from the controller 20 to determine whether or not to allow the hydraulic oil discharged from the hydraulic pump/motor 9 to flow into the main line 30.

A pressure sensor 16 is disposed in the main line 30 to detect the discharge pressure of the main pump 3. An electric energy storage amount sensor 17 is disposed in the electric energy storage device 8 to detect the amount of electric energy reserved in the electric energy storage device 8. The present embodiment includes a voltage sensor to detect the voltage value of the electric energy storage device. A discharge pressure detection signal of the main pump 3, which is output from the pressure sensor 16, and an electric energy storage amount detection signal of the electric energy storage device 8, which is output from the electric energy storage amount sensor 17, are input to the controller 20.

The controller 20 includes an input section, a computation section, a memory section, and an output section. The input section acquires an operation signal concerning each operating lever (not shown), the discharge pressure detection signal concerning the main pump 3, which is generated by the pressure sensor 16, and the electric energy storage amount detection signal concerning the electric energy storage device 8, which is output from the electric energy storage amount sensor 17. The computation section performs a later-described computation process in accordance with the above-mentioned detection signals. The memory section memorizes, for example, later-described predetermined electric energy storage amount reference values, which define high, medium, and low reference values, for the electric energy storage device 8 and later-described predetermined discharge pressure reference values, which define high and low reference values, for the main pump 3. The output section not only outputs a discharge rate command, which is calculated by the computation section, to the displacement control device 3*a* for the purpose of controlling the discharge rate of the main pump 3, but also outputs a power running command or a regeneration command, which is calculated by the computation section, to the generator-motor 7 for the purpose of controlling the torque of the hydraulic pump/motor 9. Further, in order to control the open/closed status of each switching valve 11*a* to 11*c*, the output section outputs an electric current command to electromagnetic operation sections of the switching valves 11*a* to 11*c* at an open/close timing that has been calculated at the computation section.

Figure 4:
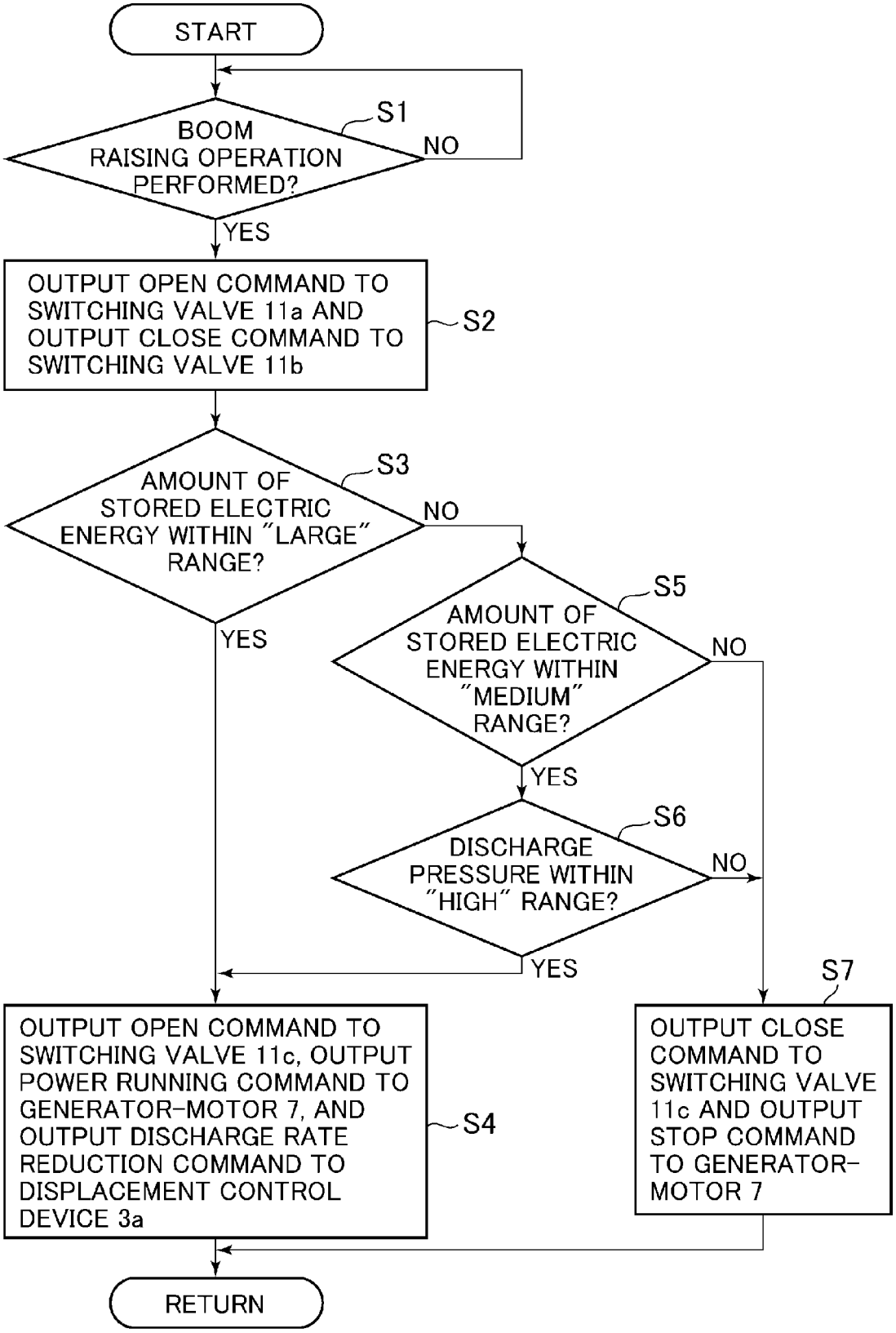
FIG. 4 is a flowchart illustrating a process performed by the controller included in the first embodiment of the construction machinery according to the present invention.

A process performed by the computation section of the controller 20 will now be described with reference to FIGS. 3 and 4. FIG. 3 is a table illustrating an example of hydraulic pump/motor drive conditions for the controller included in the first embodiment of the construction machinery according to the present invention. FIG. 4 is a flowchart illustrating the process performed by the controller included in the first embodiment of the construction machinery according to the present invention. Elements that are shown in FIGS. 3 and 4 and designated by the same reference numerals as elements shown in FIG. 2 are identical with the elements shown in FIG. 2 and will not be described in detail.

The present embodiment is characterized in that the electric energy stored in the electric energy storage device 8 is efficiently re-used. Therefore, when a boom raising operation is performed, the controller 20 determines drive efficiency in accordance with predefined conditions and exercises control to drive or stop the hydraulic pump/motor 9.

The table of FIG. 3 shows drive/stop determination criteria for the hydraulic pump/motor 9 controlled by the controller 20. The electric energy storage amount indicated in the vertical column (high, medium, or low) is determined by comparing the amount of electric energy stored in the electric energy storage device 8, which is detected by the electric energy storage amount sensor 17, with predetermined reference values, which define high, medium, and low, for the amount of electric energy stored in the electric energy storage device 8. Further, the discharge pressure indicated in the horizontal column (high or low) is determined by comparing the discharge pressure detection signal concerning the main pump 3, which is generated by the pressure sensor 16, with the predetermined reference pressure value for the discharge pressure of the main pump 3. More specifically, the discharge pressure is determined to be high when the discharge pressure detection signal represents a value not lower than the reference pressure value and determined to be low when the discharge pressure detection signal represents a value lower than the reference pressure value.

For example, if the amount of electric energy stored in the electric energy storage device 8, which is detected by the electric energy storage amount sensor 17, is within the range of the predetermined "high" reference value of the amount of electric energy stored in the electric energy storage device 8, the controller 20 exercises control to drive the hydraulic pump/motor 9 regardless of whether the main pump's discharge pressure represented by the discharge pressure detection signal of the main pump 3, which is generated by the pressure sensor 16, is high or low.

If the amount of electric energy stored in the electric energy storage device 8 is within the range of the predetermined "medium" reference value range for the amount of electric energy stored in the electric energy storage device 8, the controller 20 exercises control to drive the hydraulic pump/motor 9 when the discharge pressure detection signal of the main pump 3 represents a value not lower than the reference pressure value or exercises control to stop the hydraulic pump/motor 9 when the discharge pressure detection signal of the main pump 3 represents a value lower than the reference pressure value.

If the amount of electric energy stored in the electric energy storage device 8 is within the range of the predetermined "low" reference value range for the amount of electric energy stored in the electric energy storage device 8, the controller 20 exercises control to stop the hydraulic pump/motor 9 regardless of whether the main pump's discharge pressure represented by the discharge pressure detection signal of the main pump 3, which is generated by the pressure sensor 16, is high or low.

A process performed by the controller 20 will now be described with reference to FIG. 4.

The controller 20 first determines whether or not a boom raising operation has been performed yet (step S1). Specifically, this determination is made by checking whether a boom raising operation signal has been input by an operating lever (not shown). If a boom raising operation has been performed, processing proceeds to step S2. If not, processing returns to step S1.

The controller 20 then outputs an open command to the switching valve 11*a* and a close command to the switching valve 11*b* (step S2). This outputting permits the hydraulic oil from the main pump 3 to be supplied through the regulating valve 5 to the bottom side oil chamber 6*a* of the boom cylinder 6 shown in FIG. 2 and closes a recovery system for the hydraulic pump/motor 9.

The controller 20 determines whether the amount of electric energy stored in the electric energy storage device 8 is within the high reference value range (step S3). Specifically, this determination is made by comparing the amount of electric energy stored in the electric energy storage device 8, which is detected by the electric energy storage amount sensor 17, with the predetermined high reference value of the amount of electric energy stored in the electric energy storage device 8. If the amount of electric energy stored in the electric energy storage device 8 is within the high reference value range, processing proceeds to step S4. If not, processing proceeds to step S5.

The controller 20 outputs an open command to the switching valve 11*c*, a power running command to the generator-motor 7, and a discharge rate decrease command to the displacement control device 3*a* (step S4). This outputting drives the generator-motor 7 shown in FIG. 2 in a power running mode, operates the hydraulic pump/motor 9 as a hydraulic pump, supplies the hydraulic oil discharged from the hydraulic pump/motor 9 to the main line 30 through the sub-line 33 and the switching valve 11*c*, and causes the hydraulic oil from the hydraulic pump/motor 9 to mix with the hydraulic oil from the main pump 3.

Further, the discharge rate of the main pump 3 is controlled to be lower by the amount of hydraulic oil supplied from the hydraulic pump/motor 9. Therefore, the amount of hydraulic oil supplied to the boom cylinder 6 remains unchanged while the load on the engine 1 becomes smaller, the load serving as a drive source. This smaller load makes it possible to reduce the fuel consumption of the engine 1.

If the result of determination in step S3 does not indicate that the amount of electric energy stored in the electric energy storage device 8 is within the high reference value range, on the other hand, the controller 20 determines whether the amount of electric energy stored in the electric energy storage device 8 is within the medium reference value range (step S5). Specifically, this determination is made by comparing the amount of electric energy stored in the electric energy storage device 8, which is detected by the electric energy storage amount sensor 17, with the predetermined medium reference value of the amount of electric energy stored in the electric energy storage device 8. If the amount of electric energy stored in the electric energy storage device 8 is within the medium reference value range, processing proceeds to step S6. If not, processing proceeds to step S7.

The controller 20 determines whether the discharge pressure of the main pump 3 is not lower than the reference pressure value (step S6). Specifically, this determination is made by comparing the discharge pressure detection signal of the main pump 3, which is generated by the pressure sensor 16, with the predetermined reference pressure value for the discharge pressure of the main pump 3. If the discharge pressure of the main pump 3 is not lower than the reference pressure value, processing proceeds to step S4. In other cases, processing proceeds to step S7.

The controller 20 outputs an open command to the switching valve 11*c*, and a stop command to the generator-motor 7 (step S7). This outputting stops the generator-motor 7 shown in FIG. 2 as well as the hydraulic pump/motor 9, and shuts off the supply of the hydraulic oil discharged from the hydraulic pump/motor 9 to the main line 30.

Operations performed in the first embodiment of the construction machinery according to the present invention will now be described. The control exercised by the controller 20 when the amount of electric energy stored in the electric energy storage device 8 is within the low reference value range will first be described. In this instance, as mentioned earlier, the controller 20 exercises control to stop the hydraulic pump/motor 9 without regard to the value of the discharge pressure detection signal of the main pump 3, which is generated by the pressure sensor 16.

With reference to FIG. 2, the regulating valve 5 for operating the boom is in neutral position. In this instance, the center port 5T establishes communication while the connection ports 5*a*, 5*b* are respectively disconnected from the inlet port 5*c* and the outlet port 5*d*. Therefore, the hydraulic oil from the main pump 3 is supplied to the hydraulic oil tank 14.

When an operator performs a boom raising operation with an operating lever (not shown), a pilot pressure supplied to a pilot-operated section (not shown) moves the regulating valve 5 for operating the boom rightward into the A position. This moving causes the inlet port 5*c* to communicate with the connection port 5*a* and further causes the outlet port 5*d* to communicate with the connection port 5*b*. Moreover, in accordance with the determination criteria shown in FIG. 3, the controller 20 uses input signals indicative of the discharge pressure of the main pump 3 and the amount of electric energy stored in the electric energy storage device 8 to determine whether control should be exercised to drive or stop the hydraulic pump/motor 9. In the above-described situation, the controller 20 exercises control to stop the hydraulic pump/motor 9. The controller 20 inputs a boom raising operation signal, and outputs an open command to the electromagnetic operation section of the switching valve 11*a*, a close command to the electromagnetic operation section of the switching valve 11*b*, and a close command to the electromagnetic operation section of the switching valve 11*c*. Furthermore, the controller 20 outputs a stop command to the generator-motor 7.

Hence, the hydraulic oil from the main pump 3 is supplied to the bottom side oil chamber 6*a* of the boom cylinder 6 through the first line 31. The hydraulic oil in the rod side oil chamber 6*b* of the boom cylinder 6 is discharged into the hydraulic oil tank 14 through the second line 32. As a result, the piston rod of the boom cylinder 6 extends.

Meanwhile, if the operator performs a boom lowering operation in the above-described state, the pilot pressure supplied to the pilot-operated section (not shown) moves the regulating valve 5 for operating the boom leftward into the B position. This moving causes the inlet port 5*c* to communicate with the connection port 5*b* and further causes the outlet port 5*d* to communicate with the connection port 5*a*. Moreover, the controller 20 inputs a boom lowering operation signal and outputs a close command to the electromagnetic operation section of the switching valve 11*a* and an open command to the electromagnetic operation section of the switching valve 11*b*. Hence, the hydraulic oil from the main pump 3 is supplied to the rod side oil chamber 6*b* of the boom cylinder 6 through the second line 32 to contract the piston rod of the boom cylinder 6. At the same time, the hydraulic oil discharged from the bottom side oil chamber 6*a* of the boom cylinder 6 is introduced into the hydraulic pump/motor 9 through the sub-line 33. This introduction causes the hydraulic pump/motor 9 to operate as a hydraulic motor so as to rotate the generator-motor 7. In this instance, the controller 20 exercises regeneration control of the generator-motor 7 to generate torque in a direction opposite to the direction of rotation and stores the generated electric power in the electric energy storage device 8.

Control exercised by the controller 20 when the amount of electric energy stored in the electric energy storage device 8 is within the high reference value range shown in FIG. 3 will now be described. In this instance, as mentioned earlier, the controller 20 exercises control to drive the hydraulic pump/motor 9 without regard to the value of the discharge pressure detection signal of the main pump 3, which is generated by the pressure sensor 16.

When the operator performs a boom raising operation with an operating lever (not shown), the regulating valve 5 and other components perform the same operations as described earlier.

In accordance with the determination criteria shown in FIG. 3, the controller 20 uses input signals indicative of the discharge pressure of the main pump 3 and the amount of electric energy stored in the electric energy storage device 8 to determine whether control should be exercised to drive or stop the hydraulic pump/motor 9. In the above-described situation, the controller 20 exercises control to drive the hydraulic pump/motor 9. The controller 20 inputs a boom raising operation signal, and outputs an open command to the electromagnetic operation section of the switching valve 11*a*, a close command to the electromagnetic operation section of the switching valve 11*b*, and an open command to the electromagnetic operation section of the switching valve 11*c*. Further, the controller 20 outputs a power running command to the generator-motor 7 to operate the hydraulic pump/motor 9 as a hydraulic pump, so that the hydraulic oil discharged from the hydraulic pump/motor 9 mixes with the hydraulic oil discharged from the main pump 3 in the main line 30 through the sub-line 33 and the switching valve 11*c*.

Meanwhile, the controller 20 outputs a discharge rate decrease command to the displacement control device 3*a* and exercises control to reduce the displacement of the main pump 3 by the amount of hydraulic oil discharged from the hydraulic pump/motor 9 to mix into the main line 30. Hence, the amount of hydraulic oil supplied to the boom cylinder 6 remains unchanged regardless of whether the hydraulic pump/motor 9 is driven or stopped. Thus, no operability change occurs when the hydraulic pump/motor 9 is driven or stopped. Further, as the discharge rate of the main pump 3 is reduced, the load on the engine 1, which acts as a drive source, becomes smaller. This smaller load makes it possible to reduce the fuel consumption of the engine 1.

Although the present embodiment is described with the boom cylinder 6 cited as an example, the present invention is not limited to a situation where the boom cylinder 6 is used as an actuator. If an actuator other than the boom cylinder 6 shown in FIG. 2 is disposed and it is necessary to supply the hydraulic oil to this actuator, the controller 20 uses the determination criteria shown in FIG. 3 to determine whether the hydraulic pump/motor 9 is to be driven or stopped. When the hydraulic pump/motor 9 is to be driven, the controller 20 outputs an open command to the electromagnetic operation section of the switching valve 11*c*. Further, the controller 20 outputs a power running command to the generator-motor 7 to operate the hydraulic pump/motor 9 as a hydraulic pump, so that the hydraulic oil discharged from the hydraulic pump/motor 9 mixes with the hydraulic oil discharged from the main pump 3 in the main line 30 through the sub-line 33 and the switching valve 11*c*. Furthermore, the controller 20 outputs a discharge rate decrease command to the displacement control device 3*a* and exercises control to reduce the displacement of the main pump 3 by the amount of hydraulic oil additionally discharged from the hydraulic pump/motor 9.

Figure 5:
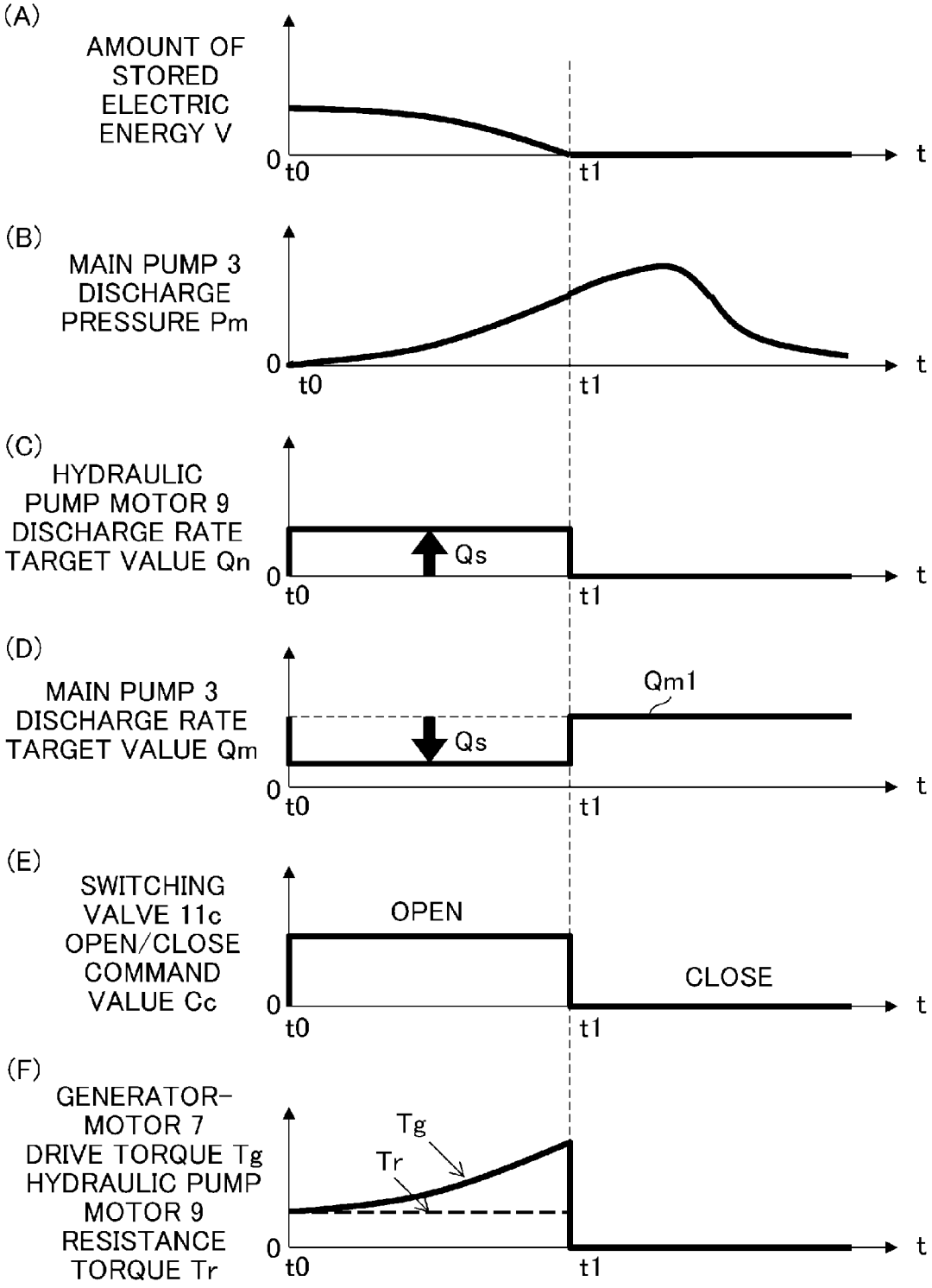
FIG. 5 is a characteristic diagram illustrating the discharge pressure and discharge rate target value of a main pump and hydraulic pump/motor in the construction machinery and an showing exemplary relation between the drive torque of a generator-motor and the resistance torque of the hydraulic pump/motor.

A problem encountered when the hydraulic pump/motor 9 is subjected to control of drive in accordance with the amount of electric energy stored in the electric energy storage device 8 and without regard to the discharge pressure of the main pump 3 will now be described with reference to FIG. 5. FIG. 5 is a characteristic diagram illustrating the discharge pressure and discharge rate target value of the main pump and hydraulic pump/motor in the construction machinery and showing an exemplary relation between the drive torque of the generator-motor and the resistance torque of the hydraulic pump/motor. In order to illustrate the features of the present embodiment, FIG. 5 shows an exemplary operation that is performed when the hydraulic pump/motor 9 is driven while electric energy is stored in the electric energy storage device 8 and is stopped while no electric energy is stored in the electric energy storage device 8 in a situation where a lever operation that will bring about the necessity of supplying the hydraulic oil to an actuator is performed to change the discharge pressure of the main pump 3.

With reference to FIG. 5, the horizontal axis represents time, and vertical axes (A) to (F), from top to bottom, represent the amount of electric energy V stored in the electric energy storage device 8, the discharge pressure Pm of the main pump 3, a target value Qh for the discharge rate of the hydraulic pump/motor 9, a target value Qm for the discharge rate of the main pump 3, an open/close command value Cc for the switching valve 11*c*, and the drive torque Tg of the generator-motor 7 and the resistance torque Tr of the hydraulic pump/motor, respectively. At time t0, a lever operation that will bring about the necessity of supplying the hydraulic oil to an actuator is performed. At time t1, the amount of electric energy stored in the electric energy storage device 8 is reduced to zero as the stored electric energy is consumed by the generator-motor 7 which drives the hydraulic pump/motor 9.

When a boom raising operation is performed during an interval between time t0 and time t1 during which the amount of electric energy V stored in the electric energy storage device 8 is sufficient, the controller 20 inputs a boom raising operation signal and, as shown at (E) of FIG. 5, outputs an open command to the electromagnetic operation section of the switching valve 11*c*. Further, as shown at (F) of FIG. 5, the controller 20 outputs a power running command (torque command) to the generator-motor 7 to operate the hydraulic pump/motor 9 as a hydraulic pump, so that the hydraulic oil discharged from the hydraulic pump/motor 9 mixes with the hydraulic oil discharged from the main pump 3 in the main line 30 through the sub-line 33 and the switching valve 11*c*. The torque command used in the above instance is computed in accordance with a target value Qs for the discharge rate of the hydraulic pump/motor 9 that is shown at (C) of FIG. 5.

Meanwhile, the controller 20 outputs a discharge rate decrease command to the displacement control device 3*a* in accordance with a target value determined by subtracting Qs from a conventional discharge rate target value Qm1 as shown at (D) of FIG. 5 for the purpose of reducing the discharge rate by the amount of hydraulic oil that is discharged from the hydraulic pump/motor 9 and mixed into the main line 30.

At time t1, the hydraulic pump/motor 9 is subjected to control of stop after the amount of electric energy V stored in the electric energy storage device 8, which is shown at (A) of FIG. 5, is reduced to zero. The controller 20 not only changes the discharge rate target value Qm back to the conventional discharge rate target value Qm1 as shown at (D) of FIG. 5, but also outputs a close command to the electromagnetic operation section of the switching valve 11*c* as shown at (E) of FIG. 5. As shown at (B) of FIG. 5, the discharge pressure Pm of the main pump 3 further gradually increases at and after time t1.

During an interval between time t0 and time t1, the hydraulic pump/motor 9 is subjected to control of drive. During the interval between time t0 and time t1, the discharge pressure Pm of the main pump 3 gradually increases as shown at (B) of FIG. 5. Since the hydraulic pump/motor 9 is driven while the discharge pressure Pm of the main pump 3 is staying low, the ratio of the resistance torque Tr to the torque Tg for driving the generator-motor 7 is undesirably high as shown at (F) of FIG. 5. Then, at time t1 at which the ratio of the resistance torque Tr to the torque Tg for driving the generator-motor 7 is decreasing, there is no alternative but to stop the hydraulic pump/motor 9 as the amount of electric energy V stored in the electric energy storage device 8 is reduced to zero. In other words, most of recovered energy V is consumed by the resistance torque Tr, leading to worse energy efficiency.

Figure 6:
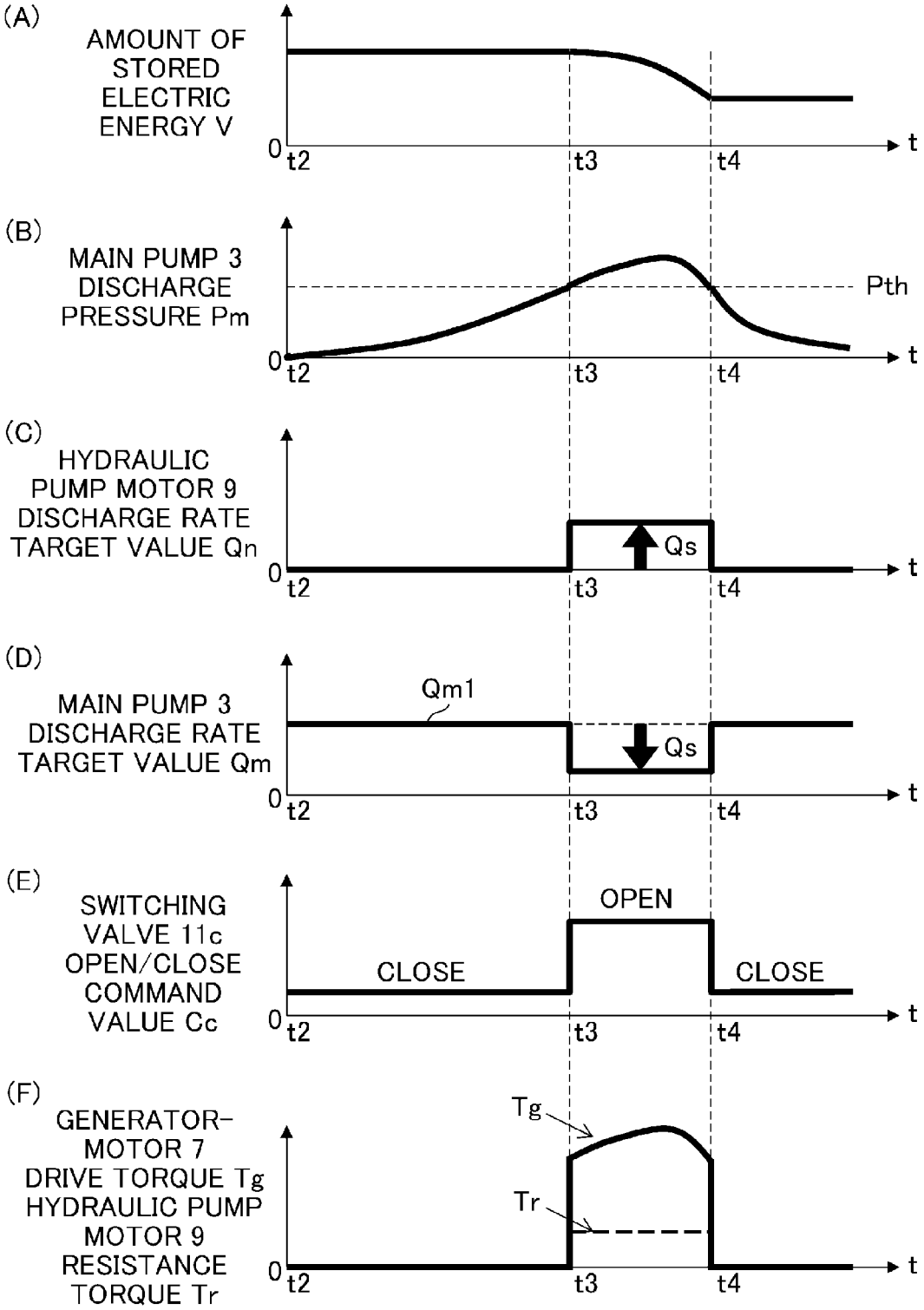
FIG. 6 is a characteristic diagram illustrating the discharge pressure and discharge rate target value of the main pump and hydraulic pump/motor in the first embodiment of the construction machinery according to the present invention and showing an exemplary relation between the drive torque of the generator-motor and the resistance torque of the hydraulic pump/motor.

In view of the above circumstances, the present embodiment determines the drive efficiency of the hydraulic pump/motor 9 on the basis of the amount of electric energy V stored in the electric energy storage device 8 and the discharge pressure Pm of the main pump 3, and exercises control to drive or stop the hydraulic pump/motor 9. The transition of the discharge pressure Pm of the main pump 3 and of the torque Tg for driving the generator-motor 7 when the hydraulic pump/motor 9 is driven or stopped will now be described with reference to FIG. 6. FIG. 6 is a characteristic diagram illustrating the discharge pressure and discharge rate target value of the main pump and hydraulic pump/motor in the first embodiment of the construction machinery according to the present invention and showing an exemplary relation between the drive torque of the generator-motor and the resistance torque of the hydraulic pump/motor. Elements that are shown in FIG. 6 and designated by the same reference numerals as elements shown in FIGS. 2 to 5 are identical with the elements shown in FIGS. 2 to 5 and will not be described in detail.

At time t2, a lever operation that will bring about the necessity of supplying the hydraulic oil to an actuator is performed. At time t3, the discharge pressure Pm of the main pump 3 is not lower than a reference pressure Pth. At time t4, the discharge pressure Pm of the main pump 3 is lower than the reference pressure Pth. A procedure for setting the reference pressure Pth and other details will be described later.

The amount of electric energy V stored in the electric energy storage device 8, which is shown at (A) of FIG. 6, is within the medium reference value range of the controller 20 at any point of time between time t2 and time t4.

When a lever operation for boom raising is performed at time t2, the controller 20 first inputs a boom raising operation signal and, as shown at (D) of FIG. 6, increases the target value Qm for the discharge rate of the main pump 3 to Qm1. During an interval time t2 and a point of time earlier than time t3, since the discharge pressure Pm of the main pump 3 is lower than the reference pressure Pth, the controller 20 does not exercise control to drive the hydraulic pump/motor 9. In other words, only the hydraulic oil discharged from the main pump 3 is supplied to the boom cylinder 6.

Next, at time t3, the discharge pressure Pm of the main pump 3 is not lower than the reference pressure Pth as shown at (B) of FIG. 6. In this instance, the controller 20 outputs an open command to the electromagnetic operation section of the switching valve 11*c* as shown at (E) of FIG. 6. Further, the controller 20 outputs a power running command (torque command) to the generator-motor 7 as shown at (F) of FIG. 6. The power running command (torque command) is computed in accordance with the target value Qs for the discharge rate of the hydraulic pump/motor 9 that is shown at (C) of FIG. 6.

Moreover, the controller 20 outputs a discharge rate decrease command to the displacement control device 3*a* in accordance with a target value determined by subtracting Qs from the conventional discharge rate target value Qm1 as shown at (D) of FIG. 6 for the purpose of reducing the discharge rate by the amount of hydraulic oil that is discharged from the hydraulic pump/motor 9 and mixed into the main line 30.

At time t4, the hydraulic pump/motor 9 is subjected to control of stop after the discharge pressure Pm of the main pump 3 is lower than the reference pressure Pth as shown at (B) of FIG. 6. The controller 20 not only changes the discharge rate target value Qm back to the conventional discharge rate target value Qm1 as shown at (D) of FIG. 6, but also outputs a close command to the electromagnetic operation section of the switching valve 11*c* as shown at (E) of FIG. 6. As shown at (B) of FIG. 6, the discharge pressure Pm of the main pump 3 further gradually decreases at and after time t4.

During an interval between time t3 and time t4, the hydraulic pump/motor 9 is subjected to control of drive. During the interval between time t3 and time t4, the discharge pressure Pm of the main pump 3 is not lower than the reference pressure Pth. As described above, the hydraulic pump/motor 9 is driven while the discharge pressure Pm of the main pump 3 is not lower than the reference pressure Pth. Therefore, the ratio of the resistance torque Tr to the torque Tg for driving the generator-motor 7 can be decreased as shown at (F) of FIG. 6. In this manner, the present embodiment exercises control to drive the hydraulic pump/motor 9 while the drive efficiency of the hydraulic pump/motor 9 is high, making it possible to use recovered energy V with high efficiency.

Figure 7:
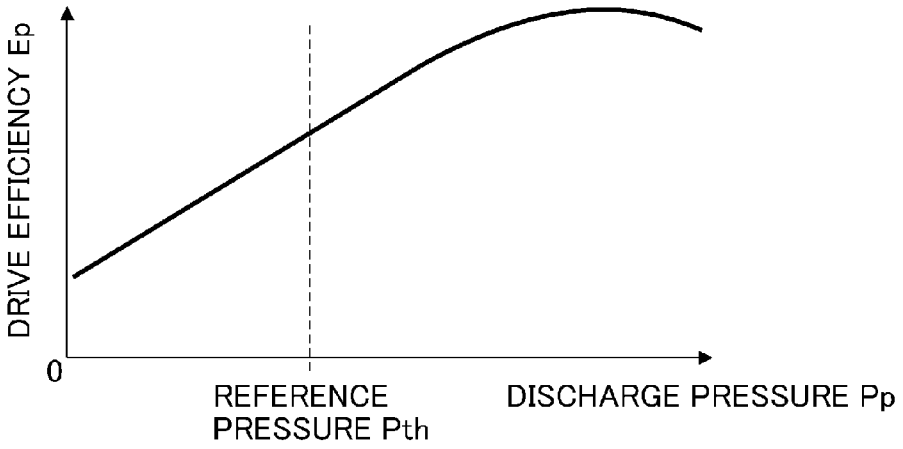
FIG. 7 is a characteristic diagram illustrating an example of the drive efficiency of the hydraulic pump/motor included in the first embodiment of the construction machinery according to the present invention.

Setting the reference pressure Pth for the discharge pressure of the main pump 3 will now be described with reference to FIG. 7. FIG. 7 is a characteristic diagram illustrating an example of the drive efficiency of the hydraulic pump/motor included in the first embodiment of the construction machinery according to the present invention. In FIG. 7, the horizontal axis represents the pump discharge pressure Pp of the hydraulic pump/motor 9, and the vertical axis represents the pump drive efficiency Ep of the hydraulic pump/motor 9.

As shown in FIG. 7, the drive efficiency Ep of the hydraulic pump/motor 9 gradually increases in accordance with the discharge pressure Pp of the hydraulic pump/motor 9 and is maximized at a predetermined discharge pressure. Therefore, the drive efficiency can be improved by driving the hydraulic pump/motor 9 when the discharge pressure of the main pump 3 is not lower than the reference pressure Pth. Here, the drive efficiency can be defined as the ratio of the output of the hydraulic pump/motor 9 to the output of a prime mover (generator-motor 7) that pump-drives the hydraulic pump/motor 9. For example, the output from the electric energy storage device 8 may be used as the output of the prime mover.

The reference pressure Pth may be set in advance, for example, by experimentally determining a pressure at which the amount of charge into and the amount of discharge from the electric energy storage device 8 are maintained in balance when the hydraulic pump/motor 9 is subjected to power running/regeneration control in a common operating mode of the construction machinery.

As described above, the present embodiment exercises control to drive the hydraulic pump/motor 9 while the drive efficiency of the hydraulic pump/motor 9 is high. The range within which the drive efficiency of the hydraulic pump/motor 9 is high may be set as described below.

As shown in FIG. 3, the controller 20 compares the discharge pressure Pm of the main pump 3 with the reference pressure Pth to determine whether control should be exercised to drive or stop the hydraulic pump/motor 9. Alternatively, however, this determination may be made by checking whether the torque of the generator-motor 7 that is required to drive the hydraulic pump/motor 9 is higher or lower than a reference torque. The reason is that the higher the torque for driving the hydraulic pump/motor 9 is, the higher the drive efficiency of the hydraulic pump/motor 9 tends to be. Hence, as long as the amount of stored electric energy is within the medium reference value range, the hydraulic pump/motor 9 is subjected to control of drive when the torque of the generator-motor 7 is higher than the reference torque and the hydraulic pump/motor 9 is subjected to control of stop when the torque of the generator-motor 7 is lower than the reference torque. In this case a torque sensor 19 may be installed and used as a torque detection device for detecting the torque of the generator-motor 7, or electric power supplied to the generator-motor 7 may alternatively be measured.

With reference to FIG. 3, when the amount of stored electric energy is within the medium reference value range, the controller 20 compares the discharge pressure Pm of the main pump 3 with the reference pressure Pth to determine control of drive or stop should be performed on the hydraulic pump/motor 9. However, alternative control may be exercised, without comparing the discharge pressure Pm of the main pump 3 with the reference pressure Pth, on the drive of the hydraulic pump/motor 9 when the discharge pressure Pm of the main pump 3 is within a predetermined range and on the stop of the hydraulic pump/motor 9 when the discharge pressure Pm of the main pump 3 is outside the predetermined range. Such a configuration makes it possible to exercise control to drive or stop the hydraulic pump/motor 9 with high efficiency even when, for instance, the drive efficiency of the hydraulic pump/motor 9 decreases with a discharge pressure increasing above a peak value. Consequently, recovered energy can be efficiently used.

Figure 8:
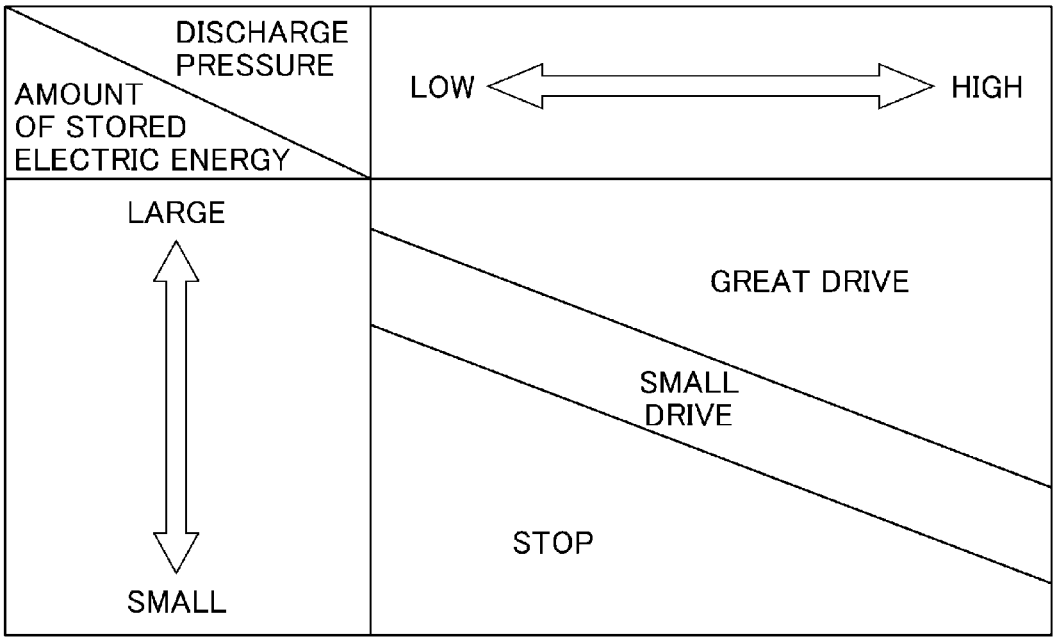
FIG. 8 is a table illustrating another example of hydraulic pump/motor drive conditions for the controller included in the first embodiment of the construction machinery according to the present invention.

Although an example of hydraulic pump/motor 9 drive conditions for the controller 20 is shown in FIG. 3, the configuration in FIG. 8 may be adopted as well. FIG. 8 is a table illustrating another example of hydraulic pump/motor drive conditions for the controller included in the first embodiment of the construction machinery according to the present invention.

FIG. 8 differs from FIG. 3 in that the former provides gradual changes by classifying a drive amount provided by drive control of the hydraulic pump motor 9 into "great drive" and "small drive". "Great drive" and "small drive" respectively denote great and small target values for the discharge rate of the hydraulic pump/motor 9. These target values are preset in the controller 20. An alternative is to predefine more detailed gradual changes in the drive amount for the hydraulic pump/motor 9 than indicated in FIG. 8. Another alternative is to predefine continuous changes in the drive amount for the hydraulic pump/motor 9.

Further, although FIGS. 3 and 8 indicate that the hydraulic pump/motor 9 is to be 'driven or stopped', the hydraulic pump/motor 9 may alternatively be 'driven or driven at a reduced rotation speed'. In this instance, the hydraulic pump/motor 9 is constantly rotating. Therefore, when a high rotation speed is needed, the rotation speed can rapidly increase. When the hydraulic pump/motor 9 is to be constantly rotated, an unload valve may be provided with the discharge side of the hydraulic pump/motor 9 to ensure that no load will be imposed on the hydraulic pump/motor 9 while it is being driven at a rotation speed lower than a predetermined rotation speed.

The first embodiment of the construction machinery according to the present invention, which has been described above, makes it possible to provide construction machinery that is capable of greatly reducing the fuel consumption of the whole construction machinery by making effective use of recovered energy in order to reduce the motive power of the engine 1, which acts as a motive power source. As a result, the operating time of the construction machinery increases to provide enhanced productivity.

The present embodiment has been described on the assumption that the target values for the discharge rates of the hydraulic pump/motor 9 and main pump 3 change in a stepwise manner as shown in FIG. 5. However, the present invention is not limited to such stepwise changes in the target values. The target values may alternatively change, for example, in a smooth manner.

Further, to avoid control mode frequently switching between the drive and stop of the hydraulic pump motor 9 in a situation where the discharge pressure significantly changes, the controller 20 may use a discharge pressure signal that has been subjected to an averaging process (low-pass filtering process) or may provide hysteresis by use of a higher discharge pressure for initiating the drive of the hydraulic pump/motor 9 than a discharge pressure for stopping the hydraulic pump/motor 9.

Second Embodiment

Figure 9:
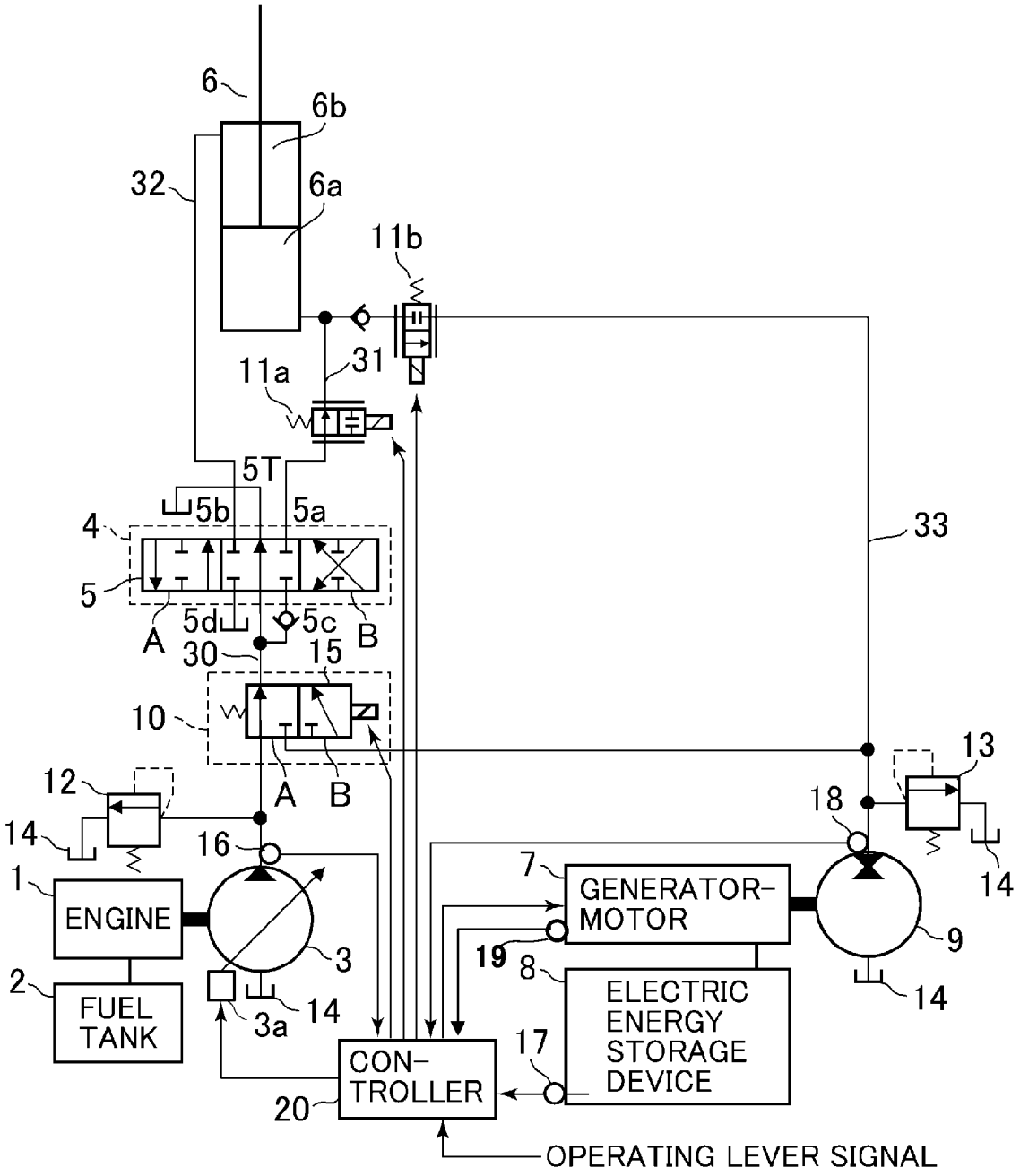
FIG. 9 is a system configuration diagram illustrating electric/hydraulic devices included in a second embodiment of the construction machinery according to the present invention.

A second embodiment of the construction machinery according to the present invention will now be described with reference to the accompanying drawings. FIG. 9 is a system configuration diagram illustrating electric/hydraulic devices included in the second embodiment of the construction machinery according to the present invention. Elements that are shown in FIG. 9 and designated by the same reference numerals as elements shown in FIGS. 2 to 8 are identical with the elements shown in FIGS. 2 to 8 and will not be described in detail.

The second embodiment of the construction machinery according to the present invention, which is shown in FIG. 9, includes substantially the same elements as the first embodiment, but differs from the first embodiment in the following elements.

In the first embodiment, the hydraulic oil supply circuit 10 is formed by the switching valve 11*c* serving as a hydraulic oil switching section. And the controller 20 issues a control command to allow if the hydraulic oil discharged from the hydraulic pump/motor 9 can mix with the hydraulic oil in the main line 30. In the second embodiment, however, the hydraulic oil supply circuit 10 is formed by a switching valve 15 serving as a hydraulic oil switching section. And the controller 20 issues a control command to select a system of supplying the hydraulic oil to the regulating valve 5 and to an actuator. Further, the sub-line 33 in the second embodiment is provided with a pressure sensor 18 that detects the discharge pressure of the hydraulic pump/motor 9. A discharge pressure detection signal concerning the hydraulic pump/motor 9, which is generated from the pressure sensor 18, is input to the controller 20.

With reference to FIG. 9, the hydraulic supply circuit 10 is formed by the switching valve 15, which is a 3-port, 2-position electromagnetic switching valve. One inlet port of the switching valve 15 is connected to the sub-line 33 into which the hydraulic oil from the hydraulic pump/motor 9 is discharged. The other inlet port is connected to the upstream side of the main line 30 into which the hydraulic oil from the main pump 3 is discharged. The outlet port of the switching valve 15 is connected to the remaining downstream end of the main line 30. The electromagnetic operation section of the switching valve 15 is connected to the controller 20.

In the second embodiment, the controller 20 selects either a hydraulic oil system into which the main pump 3 discharges the hydraulic oil or a hydraulic oil system into which the hydraulic pump/motor 9 discharges the hydraulic oil as the system of supplying the hydraulic oil to the regulating valve 5 and to the actuator. Therefore, the displacement of the hydraulic pump/motor 9 included in the second embodiment needs to be substantially the same as the displacement of the main pump 3. In this respect, the second embodiment differs from the first embodiment.

Operations performed in the second embodiment of the construction machinery according to the present invention will now be described.

In accordance with the determination criteria shown in FIG. 3, the controller 20 uses input signals indicative of the discharge pressure of the main pump 3 and the amount of electric energy stored in the electric energy storage device 8 to determine whether control should be exercised to drive or stop the hydraulic pump/motor 9. When the hydraulic pump/motor 9 is subjected to control of drive, the controller 20 outputs an open command to the electromagnetic operation section of the switching valve 11*a*, a close command to the electromagnetic operation section of the switching valve 11*b*, and a switch command to the electromagnetic operation section of the switching valve 15. The switching valve 15 moves from the A position to the B position. Further, the controller 20 outputs a power running command to the generator-motor 7 to operate the hydraulic pump/motor 9 as a hydraulic pump, so that the hydraulic oil discharged from the hydraulic pump/motor 9 is supplied to the main line 30 through the sub-line 33 and the switching valve 15.

Meanwhile, the controller 20 outputs a discharge rate decrease command to the displacement control device 3*a* and exercises control to reduce the displacement of the main pump 3, thereby reducing the discharge rate of the main pump 3 to substantially zero to an extremely low discharge rate.

As described above, when the hydraulic pump/motor 9 continues to supply the hydraulic oil, the controller 20 determines the discharge pressure of the main pump 3, which is defined in accordance with the determination criteria shown in FIG. 3, with the use of the discharge pressure detection signal concerning the hydraulic pump/motor 9, which is generated from the pressure sensor 18.

With reference to FIG. 3, if, for instance, the amount of electric energy stored in the electric energy storage device 8 is within the medium reference value range and the discharge pressure of the hydraulic pump/motor 9 is lower than the reference pressure Pth, the controller 20 exercises control to stop the hydraulic pump/motor 9. The controller 20 outputs a switch command to the electromagnetic operation section of the switching valve 15 for the purpose of moving the switching valve 15 from the B position to the A position, and stops the output of the power running command to the generator-motor 7.

Meanwhile, the controller 20 stops the output of the discharge rate decrease command to the displacement control device 3*a* and outputs a discharge rate increase command to the displacement control device 3*a*, thereby changing the discharge rate of the main pump 3 back to a level when the switching valve 15 was in the A position. As described above, the fuel consumption of the engine 1, which acts as a prime mover that drives the main pump 3, can be reduced by exercising control to drive the hydraulic pump/motor 9.

The second embodiment of the construction machinery according to the present invention, which has been described above, provides the same advantages as the first embodiment which was described earlier.

In the foregoing embodiments, the controller exercises control to drive the hydraulic pump/motor 9 when the drive efficiency of the hydraulic pump/motor 9 is not lower than the predetermined reference value and exercises control to stop the hydraulic pump/motor 9 when the drive efficiency of the hydraulic pump/motor 9 is lower than the predetermined reference value. However, the present invention is not limited to such a control scheme. For example, in a situation where the hydraulic pump/motor 9 is subjected to control of drive when the drive efficiency of the hydraulic pump/motor 9 is not lower than the predetermined reference value, different means may be used to exercise control to stop the hydraulic pump/motor 9.

The forgoing embodiments have been described on the assumption that the prime mover for the main pump 3 includes the engine 1 and the fuel tank 2. However, the present invention is not limited to such a configuration. For example, the prime mover for the main pump 3 may alternatively include an electric motor and an electric power source (power supply and electric energy storage device). Such an alternative configuration also provides the same advantages as the foregoing embodiments.

The foregoing embodiments have been described on the assumption that the motor for the hydraulic pump/motor 9 includes the generator-motor 7 and the electric energy storage device 8. However, the present invention is not limited to such a configuration. For example, the prime mover for the hydraulic pump/motor 9 may alternatively include a hydraulic pump/motor and an accumulator. Further, either the above-mentioned hydraulic pump/motor or the hydraulic pump/motor 9 according to the first embodiment may be of a variable displacement type, so that the ratio between the pressure of the accumulator and the discharge pressure of the hydraulic pump/motor 9 can be changed.

REFERENCE NUMERALS

1 . . . Engine (first prime mover)
2 . . . Fuel tank
3 . . . Main pump (first hydraulic pump)
4 . . . Control valve
5 . . . Boom operation regulating valve
6 . . . Boom cylinder (actuator)
7 . . . Generator-motor (second prime mover)
8 . . . Electric energy storage device (energy storage device)
9 . . . Hydraulic pump motor (second hydraulic pump)
10 . . . Hydraulic oil supply circuit
11*a* . . . Switching valve
11*b* . . . Switching valve
11*c* . . . Switching valve (hydraulic oil switching section)
12 . . . Relief valve
13 . . . Relief valve
14 . . . Hydraulic oil tank
15 . . . Switching valve (hydraulic oil switching section)
16 . . . Pressure sensor (discharge pressure detection device)
17 . . . Electric energy storage amount sensor (energy detection device)
18 . . . Pressure sensor
20 . . . Controller (control device)
30 . . . Main line
33 . . . Sub-line

The invention claimed is:

1. A construction machinery comprising:

an actuator;

a first hydraulic pump for discharging hydraulic oil for driving the actuator;

a first prime mover for driving the first hydraulic pump;

a second hydraulic pump for discharging hydraulic oil for driving the actuator;

a second prime mover for driving the second hydraulic pump;

an energy storage device for storing energy for driving the second prime mover; and a hydraulic oil supply circuit including a hydraulic oil switching section that accepts hydraulic oil discharged from the first hydraulic pump and hydraulic oil discharged from the second hydraulic pump and supplies either a mixture of the accepted hydraulic oils or a selected one of the accepted hydraulic oils to the actuator;

wherein the construction machinery comprises a control device that, when drive efficiency of the second hydraulic pump is higher than a preselected setting value, outputs a switch command to the hydraulic oil switching section and a drive command to the second prime mover;

wherein the control device that, when the drive efficiency of the second hydraulic pump is lower than the preselected setting value, outputs the switch command to the hydraulic oil switching section and a rotation speed reduction command or a stop command to the second prime mover;

wherein the construction machinery comprises a discharge pressure sensor for detecting a discharge pressure of the first hydraulic pump, wherein the control device acquires the discharge pressure of the first hydraulic pump, which is detected by the discharge pressure sensor, outputs the drive command to the second prime mover when the discharge pressure of the first hydraulic pump is higher than a predetermined reference pressure, and outputs the rotation speed reduction command or the stop command to the second prime mover when the discharge pressure of the first hydraulic pump is lower than the predetermined reference pressure, and wherein the control device outputs the switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the discharge pressure of the first hydraulic pump is higher than the predetermined reference pressure, and supply the hydraulic oil discharged from the first hydraulic pump to the actuator when the discharge pressure of the first hydraulic pump is lower than the predetermined reference pressure.

2. The construction machinery according to claim 1, further comprising:

a discharge pressure sensor for detecting the discharge pressure of the first hydraulic pump;

wherein the control device acquires the discharge pressure of the first hydraulic pump, which is detected by the discharge pressure sensor, outputs the drive command to the second prime mover when the discharge pressure of the first hydraulic pump is within the predetermined reference pressure range, and outputs the rotation speed reduction command or the stop command to the second prime mover when the discharge pressure of the first hydraulic pump is outside the predetermined reference pressure range; and wherein the control device outputs the switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the discharge pressure of the first hydraulic pump is within the predetermined reference pressure range, and supply the hydraulic oil discharged from the first hydraulic pump to the actuator when the discharge pressure of the first hydraulic pump is outside the predetermined reference pressure range.

3. The construction machinery according to claim 1, further comprising:

an energy detection device for detecting the amount of energy stored in the energy storage device;

wherein the control device acquires the amount of energy stored in the energy storage device, which is detected by the energy detection device, outputs the drive command to the second prime mover when the amount of energy stored in the energy storage device is higher than predetermined reference energy, and outputs the rotation speed reduction command or the stop command to the second prime mover when the amount of energy stored in the energy storage device is lower than the predetermined reference energy; and wherein the control device outputs the switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the amount of energy stored in the energy storage device is higher than the predetermined reference energy, and supply the hydraulic oil discharged from the first hydraulic pump to the actuator when the amount of energy stored in the energy storage device is lower than the predetermined reference energy.

4. The construction machinery according to claim 1, further comprising:

an electric energy storage amount sensor for detecting the output of the energy storage device, wherein the control device acquires the output of the energy storage device, which is detected by the electric energy storage amount sensor, outputs the drive command to the second prime mover when the ratio of the output of the second hydraulic pump to the output of the energy storage device is higher than the predetermined reference value, and outputs the rotation speed reduction command or the stop command to the second prime mover when the ratio of the output of the second hydraulic pump to the output of the energy storage device is lower than the predetermined reference value, and wherein the control device outputs the switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the ratio of the output of the second hydraulic pump to the output of the energy storage device is higher than the predetermined reference value, and supply the hydraulic oil discharged from the first hydraulic pump to the actuator when the ratio of the output of the second hydraulic pump to the output of the energy storage device is lower than the predetermined reference value.

5. The construction machinery according to claim 1, further comprising:

a torque sensor for detecting the drive torque of the second prime mover;

wherein the control device acquires the drive torque of the second prime mover, which is detected by the torque sensor, outputs the drive command to the second prime mover when the drive torque of the second prime mover is higher than the predetermined reference torque, and outputs the rotation speed reduction command or the stop command to the second prime mover when the drive torque of the second prime mover is lower than the predetermined reference torque; and wherein the control device outputs the switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the drive torque of the second prime mover is higher than the predetermined reference torque, and supply the hydraulic oil discharged from the first hydraulic pump to the actuator when the drive torque of the second prime mover is lower than the predetermined reference torque.

6. The construction machinery according to claim 1, further comprising:

a torque sensor for detecting the drive torque of the second prime mover;

wherein the control device acquires the drive torque of the second prime mover, which is detected by the torque sensor, outputs the drive command to the second prime mover when the drive torque of the second prime mover is higher than the predetermined reference torque, and outputs the rotation speed reduction command or the stop command to the second prime mover when the drive torque of the second prime mover is lower than the predetermined reference torque; and wherein the control device outputs the switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the drive torque of the second prime mover is higher than the predetermined reference torque, and supply the hydraulic oil discharged from the first hydraulic pump to the actuator when the drive torque of the second prime mover is lower than the predetermined reference torque.

7. The construction machinery according to claim 1, further comprising:

a discharge pressure sensor for detecting the discharge pressure of the first hydraulic pump;

wherein the control device acquires the discharge pressure of the first hydraulic pump, which is detected by the discharge pressure sensor, outputs the drive command to the second prime mover when the discharge pressure of the first hydraulic pump is within the predetermined reference pressure range, and outputs the rotation speed reduction command or the stop command to the second prime mover when the discharge pressure of the first hydraulic pump is outside the predetermined reference pressure range; and wherein the control device outputs the switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the discharge pressure of the first hydraulic pump is within the predetermined reference pressure range, and supply the hydraulic oil discharged from the first hydraulic pump to the actuator when the discharge pressure of the first hydraulic pump is outside the predetermined reference pressure range.

8. The construction machinery according to claim 1, further comprising:

a discharge pressure sensor for detecting the discharge pressure of the first hydraulic pump;

wherein the control device acquires the discharge pressure of the first hydraulic pump, which is detected by the discharge pressure sensor, outputs the drive command to the second prime mover when the discharge pressure of the first hydraulic pump is within the predetermined reference pressure range, and outputs the rotation speed reduction command or the stop command to the second prime mover when the discharge pressure of the first hydraulic pump is outside the predetermined reference pressure range; and wherein the control device outputs the switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the discharge pressure of the first hydraulic pump is within the predetermined reference pressure range, and supply the hydraulic oil discharged from the first hydraulic pump to the actuator when the discharge pressure of the first hydraulic pump is outside the predetermined reference pressure range.

9. The construction machinery according to claim 1, further comprising:

an energy detection device for detecting the amount of energy stored in the energy storage device;

wherein the control device acquires the amount of energy stored in the energy storage device, which is detected by the energy detection device, outputs the drive command to the second prime mover when the amount of energy stored in the energy storage device is higher than predetermined reference energy, and outputs the rotation speed reduction command or the stop command to the second prime mover when the amount of energy stored in the energy storage device is lower than the predetermined reference energy; and wherein the control device outputs the switch command to the hydraulic oil switching section so as to accept the hydraulic oil discharged from the first hydraulic pump and the hydraulic oil discharged from the second hydraulic pump and supply either the mixture of these two hydraulic oils or the hydraulic oil discharged from the second hydraulic pump to the actuator when the amount of energy stored in the energy storage device is higher than the predetermined reference energy, and supply the hydraulic oil discharged from the first hydraulic pump to the actuator when the amount of energy stored in the energy storage device is lower than the predetermined reference energy.

* * * * *